US006128457A

United States Patent [19]

No et al.

[11] Patent Number: 6,128,457

[45] Date of Patent: Oct. 3, 2000

[54] SQUEEZE ROLLER ELEVATING APPARATUS OF A LIQUID DEVELOPING APPARATUS

[75] Inventors: Kwang-ho No; Geun-yong Park, both of Suwon, Rep. of Korea

[73] Assignee: Samsung Electronics Co., Ltd., Kyungki-Do, Rep. of Korea

[21] Appl. No.: 09/336,783

[22] Filed: Jun. 21, 1999

[30] Foreign Application Priority Data

Jun. 22, 1998 [KR] Rep. of Korea ..... 98/23475

[51] Int. Cl.[7] ..... G03G 15/10

[52] U.S. Cl. ..... 399/249; 399/237

[58] Field of Search ..... 39/249, 237, 234; 318/116; 74/569

[56] References Cited

U.S. PATENT DOCUMENTS

| | | | |
|---|---|---|---|
| 5,915,153 | 6/1999 | Kim et al. | 399/249 |
| 5,987,285 | 11/1999 | Kusayanagi | 399/249 |
| 6,049,684 | 4/2000 | Nishikawa et al. | 399/249 |

FOREIGN PATENT DOCUMENTS 358200263 11/1983 Japan .

*Primary Examiner*—Susan S. Y. Lee

*Attorney, Agent, or Firm*—Sughrue, Mion, Zinn, Macpeak & Seas, PLLC

[57] ABSTRACT

In an apparatus for elevating a squeeze roller of a liquid developing apparatus, a sub-block having the squeeze roller selectively pressing a photoreceptor web installed thereon, is installed at a main block of the liquid developing apparatus to be capable of moving up and down. A mobile block is installed at the main block to be capable of moving up and down to support the sub-block. The mobile block is moved up and down by an elevating unit to allow the squeeze roller to contact or be separated from the photoreceptor web. A piezoelectric element is installed at the mobile block to support the sub-block and to move the sub-block up and down in a predetermined range by being reversibly transformed by electric current. A power supply selectively provides electric current to the piezoelectric element. Thus, the decline over time of the elastic force of the spring employed in the conventional elevating apparatus can be fundamentally solved. Further, when the liquid developing apparatus of the present invention is used for a long time, the pressing force of the squeeze roller to the photoreceptor web can be uniformly maintained.

3 Claims, 5 Drawing Sheets

SQUEEZE ROLLER ELEVATING APPARATUS OF A LIQUID DEVELOPING APPARATUS

BACKGROUND OF THE INVENTION

1. Field of the Invention

The present invention relates to an apparatus for elevating a squeeze roller of a liquid developing apparatus.

2. Description of the Related Art

In a general liquid electrophotographic printer, a liquid-type developing apparatus provides developer to develop an electrostatic latent image formed on a photosensitive medium such as a photoreceptor web. The liquid developing apparatus, as shown in FIG. 1, includes a developing roller 11 for providing developer injected from a nozzle 14 to an electrostatic latent image formed on a transfer surface 10*a* of the photoreceptor web 10 and a squeeze roller 12 for removing excess developer from the transfer surface 10*a*.

The squeeze roller 12 removes excess developer by pressing the photoreceptor web 10 against a backup roller 13 during a print process. Thus, during the print process, the squeeze roller 12 is required to firmly press the photoreceptor web 10 toward the backup roller 13. Also, a drip-line D that the developer leaves behind and hardens in a contact area between the squeeze roller 12 and the photoreceptor web 10 is formed due to repeated prints. To remove the drip-line D, the squeeze roller 12 must be driven in a direction reverse to that in a print mode. In a drip-line removing mode, to reduce the rotational load caused by the reverse driving of the squeeze roller 12, the pressing force of the squeeze roller 12 with respect to the photoreceptor web 10 is made lower than in the print mode. Also, when the print process is completed, the squeeze roller 12 is fully separated from the photoreceptor web 10. Thus, the liquid printer must be provided with a squeeze roller elevating apparatus which can elevate the squeeze roller 12 to press the photoreceptor web 10 and simultaneously adjust the pressing force.

FIG. 2 shows an example of a conventional squeeze roller elevating apparatus. Referring to the drawing, a sub-block 22, on which the squeeze roller 12 is installed, is installed in a main block 20 to be capable of ascending and descending. Compression springs 24 are installed between the main block 20 and the sub-block 22 to elastically bias the squeeze roller 12 toward the photoreceptor web 10. A slider 23 is installed at the main block 20 to be capable of sliding. A slanted cam groove 23*a* is formed in the slider 23, and a protrusion 22*a* formed on the sub-block 22 is inserted into the cam groove 23*a* and guided accordingly. Thus, when the slider 23 moves horizontally, the sub-block 22 can elevate. The slider 23 can move right and left by a cam 25 rotated by a driving source (not shown) and is elastically biased to the right as shown in the drawing by a tension spring 26.

In the squeeze roller elevating apparatus having the above structure, in all three modes, the print mode, the drip-line removing mode, and a print ready mode, the forces of the compression springs 24 and the tension spring 26 are continuously exerted. Hence, after prolonged use, the elastic forces of the compression springs 24 and the tension spring 26 are reduced so that an appropriate elastic force cannot be applied according to each mode.

SUMMARY OF THE INVENTION

To solve the above problem, it is an objective of the present invention to provide an apparatus for elevating a squeeze roller of a liquid developing apparatus having an improved structure so that the pressing force of the squeeze roller to the photoreceptor web can be uniformly maintained after a long use time.

Accordingly, to achieve the above objective, there is provided an apparatus for elevating a squeeze roller of a liquid developing apparatus which comprises: a sub-block having the squeeze roller for selectively pressing a photoreceptor web installed thereon and installed at a main block of the liquid developing apparatus to be capable of moving up and down; a mobile block installed at the main block to be capable of moving up and down to support the sub-block; an elevating means for moving the mobile block up and down to allow the squeeze roller to contact or be separated from the photoreceptor web; a piezoelectric element installed at the mobile block to support the sub-block for moving the sub-block up and down in a predetermined range by being reversibly transformed by electric current; and a power supply for selectively providing electric current to the piezoelectric element.

It is preferable in the present invention that the elevating means is comprised of a cam rotatably installed at the main block to support a lower portion of the mobile block and a driving motor for rotating the cam.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE PREFERRED EMBODIMENTS

Figure 1:
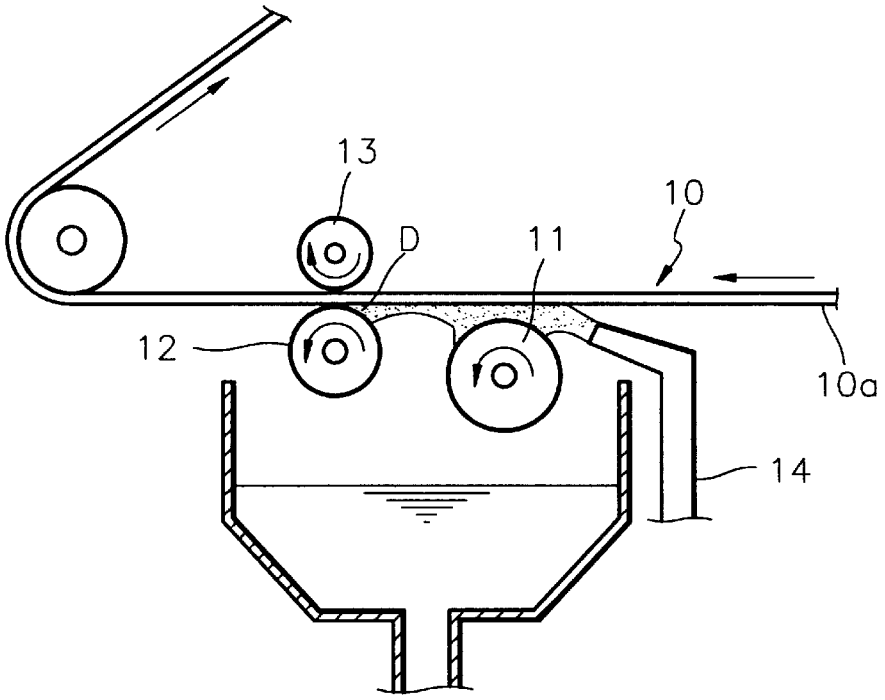
FIG. 1 (PRIOR ART)
FIG. 1 is a view schematically showing the structure of a general liquid developing apparatus.
Figure 2:
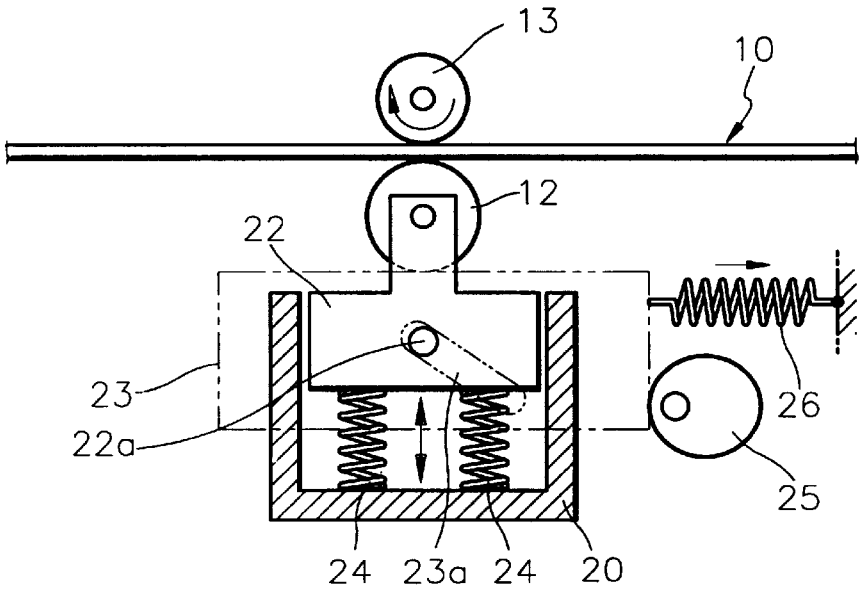
FIG. 2 (PRIOR ART)
FIG. 2 is a view showing the structure of a conventional squeeze roller elevating apparatus.

FIGS. 3 through 6 show a squeeze roller elevating apparatus according to a preferred embodiment of the present invention. Although the structure of only one side of a main block 300 of a liquid developing apparatus is shown in the drawings, the structure of the other side is the same.

Figure 3:
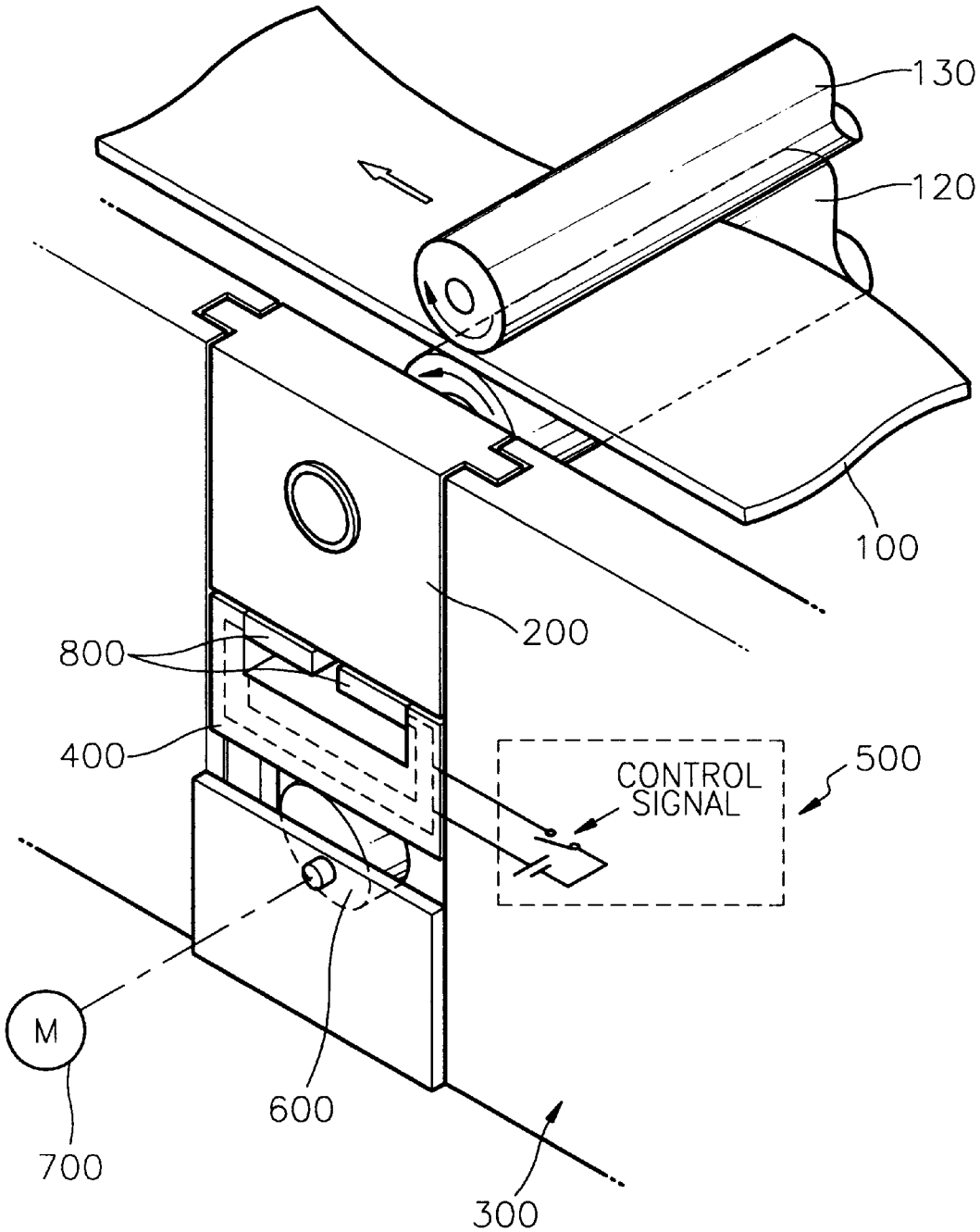
FIG. 3 is a perspective view showing a squeeze roller elevating apparatus according to the present invention.

Referring to FIG. 3, the squeeze roller elevating apparatus includes a sub-block 200 installed at the main block 300 of the liquid developing apparatus to be capable of ascending and descending and having a squeeze roller 120 installed thereon, a mobile block 400 installed at the main block 300 to be capable of ascending and descending for supporting the sub-block 200, and a piezoelectric element 800 provided at the mobile block 400 for supporting the sub-block 200. The piezoelectric element 800 moves the sub-block 200 slightly up and down by being reversibly transformed by current applied from a power supply 500 operated according to a control signal.

The mobile block 400 is moved up and down by an elevating means comprised of a cam 600 and a driving motor 700 for supporting a lower portion of the mobile block 400. That is, the mobile block 400 ascends and descends according to the rotational angle of the cam 600 driven by the driving motor 700. Reference numeral 130 denotes a backup roller for pressing a photoreceptor web 100 together with the squeeze roller 120.

The operation of the squeeze roller elevating apparatus having the structure according to the present invention will be described as follows.

Figure 4:
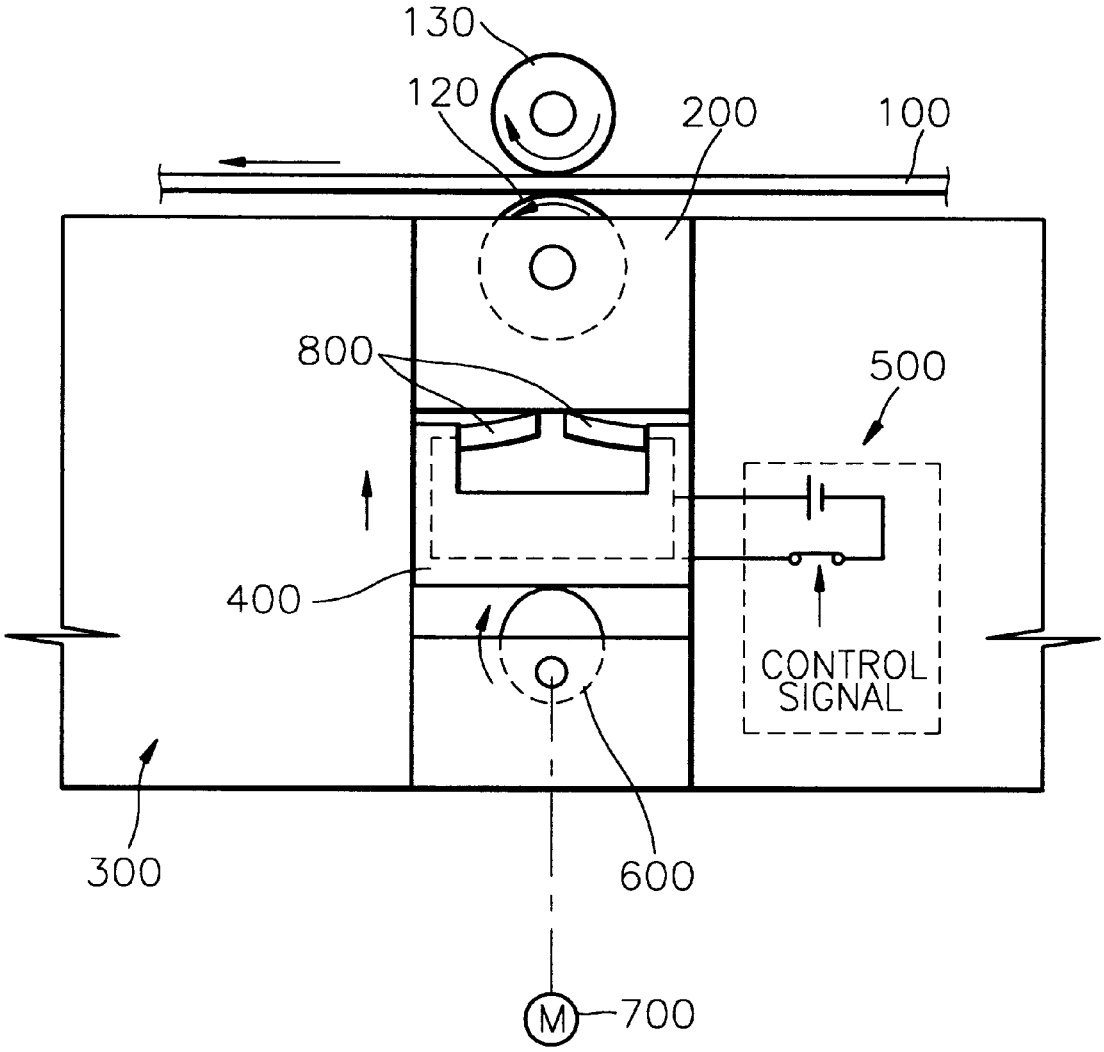
FIGS. 4 through 6 are side views for explaining the operation of the squeeze roller elevating apparatus according to the present invention, in the print mode, drip-line removing mode, and ready mode, respectively.

First, in the print mode, the squeeze roller 120 presses the photoreceptor web 100. Thus, as shown in FIG. 4, as the cam 600 is rotated by the driving motor 700, the mobile block 400 is moved up. Accordingly, the sub-block 200 supported by an upper portion of the mobile block 400 also moves up so that the squeeze roller 120 contacts the photoreceptor web 100. Thus, when the power supply 500 provides electric current to the piezoelectric element 800, the piezoelectric element 800 is transformed as shown in FIG. 4 to allow the sub-block 200 to move up further so that the squeeze roller 120 closely contacts and presses the photoreceptor web 100.

Figure 5:
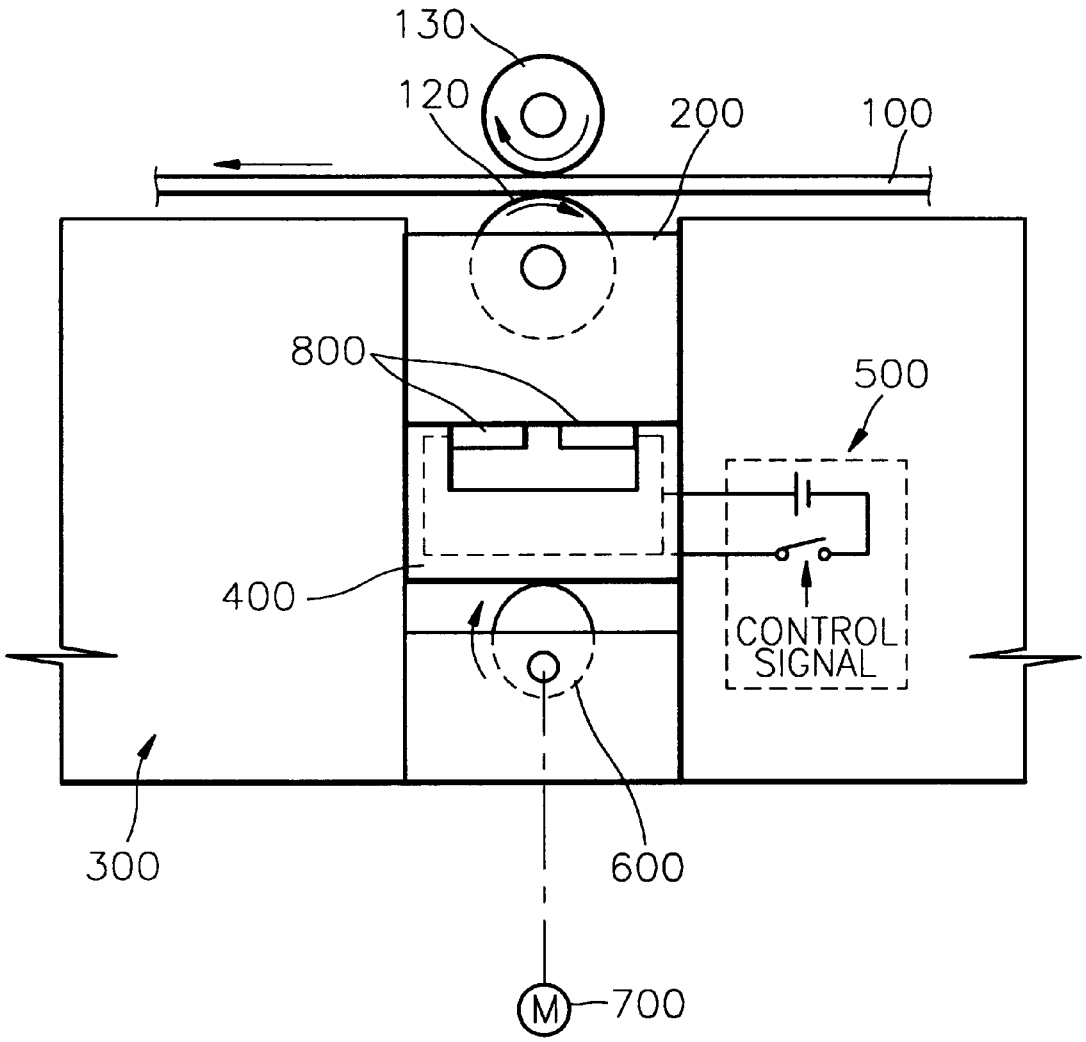

To convert the above mode to the drip-line removing mode, as shown in FIG. 5, the power supplied from the power supply 500 to the piezoelectric element 800 is cut off and the piezoelectric element 800 returns to the original state. Accordingly, although the pressing force of the squeeze roller 120 to the photoreceptor web 100 is lower than in the print mode, since the sub-block 200 is still elevated by the cam 600, the squeeze roller 120 continues to be in contact with the photoreceptor web 100. Under these circumstances, the drip-line is removed by rotating the squeeze roller 120 in reverse as shown in FIG. 5.

Figure 6:
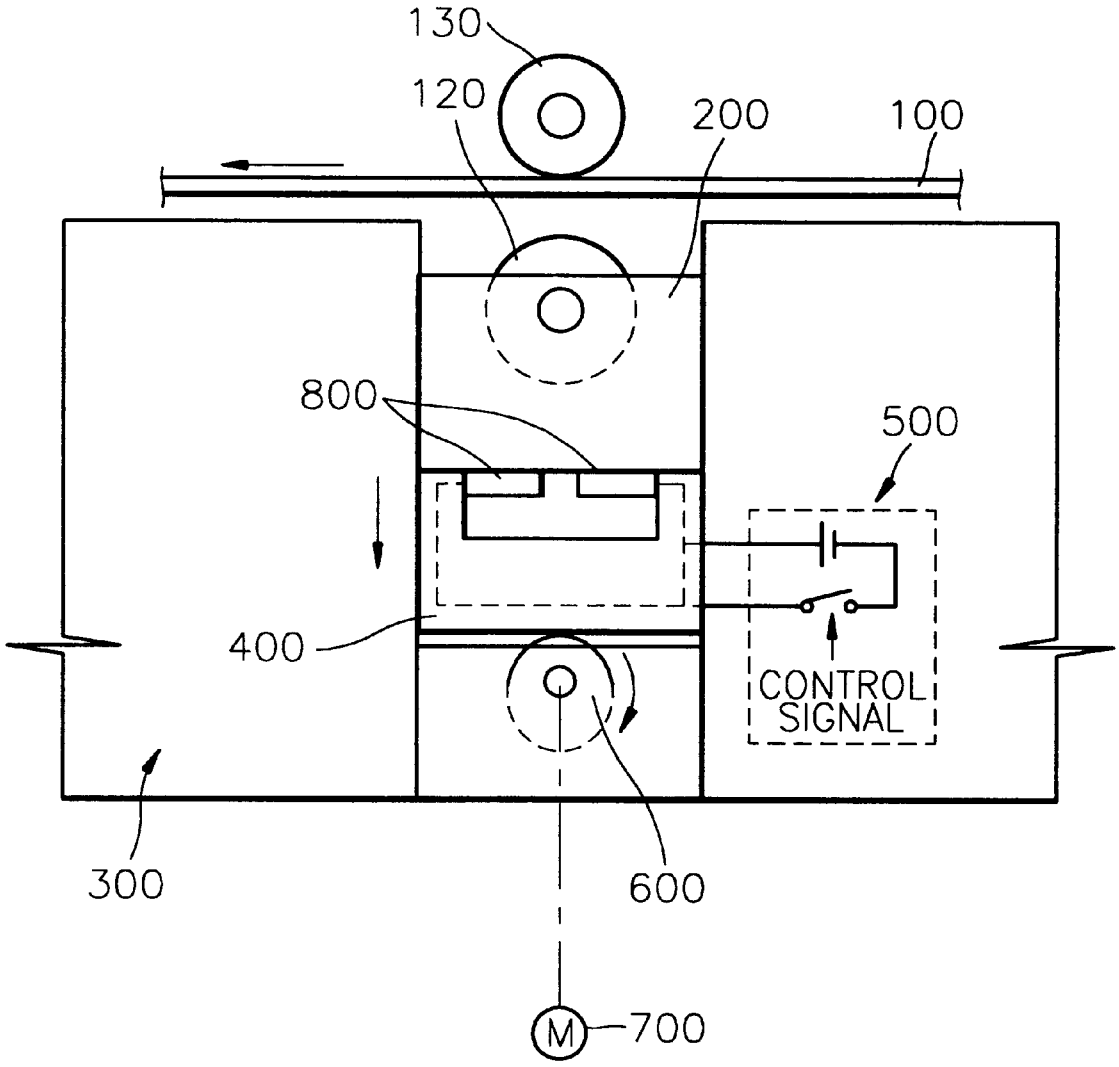

Next, in the ready mode, as shown in FIG. 6, as the driving motor 700 rotates the cam 600, the mobile block 400 and the sub-block 200 supported thereon are moved down. Accordingly, the squeeze roller 120 is separated from the photoreceptor web 100.

As described above, in the squeeze roller elevating apparatus of the present invention the advantages are that since the sub-block having the squeeze roller is raised using the cam and the piezoelectric element, the problem that the elastic force of the spring employed in the conventional elevating apparatus declines with use is fundamentally solved. Also, when the liquid developing apparatus of the present invention is used for a long time, the pressing force of the squeeze roller to the photoreceptor web can be uniformly maintained.

Although particular embodiments of the present invention have been shown and described, it is contemplated that numerous modifications may be made without departing from the spirit and scope of the invention as defined in the claims.

What is claimed is:

1. An apparatus for elevating a squeeze roller of a liquid developing apparatus, said squeeze roller elevating apparatus comprising:

a sub-block installed at a main block of said liquid developing apparatus and capable of moving up and down, said sub-block having said squeeze roller for selectively pressing a photoreceptor web installed thereon;

a mobile block installed at said main block to be capable of moving up and down to support said sub-block;

an elevating means for moving said mobile block up and down to allow said squeeze roller to one of contact and separate from said photoreceptor web;

a piezoelectric element installed at said mobile block to support said sub-block for moving said sub-block up and down in a predetermined range by being reversibly transformed by electric current; and a power supply for selectively providing electric current to said piezoelectric element.

2. The squeeze roller elevating apparatus as claimed in claim 1, wherein said elevating means comprises:

a cam rotatably installed at said main block to support a lower portion of said mobile block; and a driving motor for rotating said cam.

3. An apparatus for elevating a squeeze roller of a liquid developing apparatus, said squeeze roller elevating apparatus comprising:

a sub-block installed at a main block of said liquid developing apparatus and capable of moving up and down, said sub-block having said squeeze roller for selectively pressing a photoreceptor web installed thereon;

a mobile block installed at said main block to be capable of moving up and down to support said sub-block;

an elevator mechanism which moves said mobile block up and down to allow said squeeze roller to one of contact and separate from said photoreceptor web;

a piezoelectric element installed at said mobile block to support said sub-block for moving said sub-block up and down in a predetermined range by being reversibly transformed by electric current; and a power supply for selectively providing electric current to said piezoelectric element.

* * * * *